US010696446B2

(12) United States Patent
Lee et al.

(10) Patent No.: US 10,696,446 B2
(45) Date of Patent: Jun. 30, 2020

(54) PACKAGING BOX

(71) Applicant: ASUSTeK COMPUTER INC., Taipei (TW)

(72) Inventors: Chuan-Ming Lee, Taipei (TW); Lin-Hua Xu, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 16/205,331

(22) Filed: Nov. 30, 2018

(65) Prior Publication Data

US 2019/0168908 A1 Jun. 6, 2019

(30) Foreign Application Priority Data

Dec. 6, 2017 (CN) ..... 2017 1 1278266

(51) Int. Cl.

| | |
|---|---|
| ***B65D 5/50*** | (2006.01) |
| ***B65D 5/66*** | (2006.01) |
| ***B65D 5/46*** | (2006.01) |
| ***B65D 5/52*** | (2006.01) |

(52) U.S. Cl.

CPC ..... *B65D 5/5021* (2013.01); *B65D 5/46024* (2013.01); *B65D 5/5213* (2013.01); *B65D 5/6626* (2013.01)

(58) Field of Classification Search

CPC ..... B65D 5/5021; B65D 5/46024; B65D 5/6626; B65D 5/5213

USPC ..... 206/735, 738, 743, 754, 755, 762, 764, 206/765, 767, 768, 804, 817

See application file for complete search history.

(56) References Cited

U.S. PATENT DOCUMENTS

| | | | | | |
|---|---|---|---|---|---|
| 2,657,793 | A | * | 11/1953 | Goldshine | B65D 5/5213 206/755 |
| 2,673,642 | A | * | 3/1954 | Smalley | A47F 7/03 206/754 |
| 2,675,911 | A | * | 4/1954 | Thurston | A47F 7/03 206/754 |
| 4,896,766 | A | * | 1/1990 | Paley | B65D 5/5213 206/327 |
| 5,096,055 | A | * | 3/1992 | Opper | B65D 5/5213 206/754 |

(Continued)

FOREIGN PATENT DOCUMENTS

| | | | |
|---|---|---|---|
| CN | 2897833 | Y | 5/2007 |
| CN | 106864918 | A | 6/2017 |

*Primary Examiner* — Luan K Bui

(74) *Attorney, Agent, or Firm* — McClure, Qualey & Rodack, LLP

(57) ABSTRACT

This disclosure provides a packaging box. The packaging box includes a box body, a cover body, a pressing member, a linkage member, and a lifting member. The box body includes a base plate. The cover body is configured to be closed or opened relative to the box body. The pressing member is connected to the box body. The linkage member is connected between the pressing member and the cover body. The lifting member is connected to the box body and is located above the pressing member. When the cover body is opened relative to the box body, the linkage member moves with the cover body to drive the pressing member to press against the lifting member, so that at least one part of the lifting member is pushed by the pressing member to move away from the base plate.

10 Claims, 14 Drawing Sheets

(56) References Cited

U.S. PATENT DOCUMENTS

| | | | | | |
|---|---|---|---|---|---|
| 5,429,228 | A * | 7/1995 | Dahl | B42F 17/28 | 206/425 |
| 5,452,793 | A * | 9/1995 | DiMeo, Jr. | A45C 11/18 | 206/39 |
| 5,533,625 | A * | 7/1996 | Mikkelsen | B25H 3/003 | 206/315.1 |
| 8,651,348 | B2 * | 2/2014 | Meng | B25H 3/003 | 206/379 |
| 2012/0292227 | A1 * | 11/2012 | Aykanian | A45C 11/16 | 206/755 |

* cited by examiner

PACKAGING BOX

CROSS-REFERENCE TO RELATED APPLICATION

This application claims the priority benefit of Chinese application serial No. 201711278266.2, filed on Dec. 6, 2017. The entirety of the above-mentioned patent application is hereby incorporated by reference herein and made a part of the specification.

BACKGROUND OF THE INVENTION

Field of the Invention

This disclosure relates to a packaging box.

Description of the Related Art

Products are protected and embellished with packaging boxes. With a proper packaging, products are protected from collision during handling to avoid damage.

BRIEF SUMMARY OF THE INVENTION

According to an aspect, a packaging box is provided herein. The packaging box includes a box body, a cover body, a pressing member, a linkage member, and a lifting member. The box body includes a base plate. The cover body is configured to be closed or opened relative to the box body. The pressing member is connected to the box body or the cover body and is located in the box body. The linkage member is connected between the pressing member and the cover body. The lifting member is connected to the box body and is located above the pressing member. During opening of the cover body relative to the box body, the linkage member moves with the cover body to drive the pressing member to press against the lifting member, so that at least one part of the lifting member is pushed by the pressing member to move away from the base plate.

As described in this disclosure, during opening of the cover body relative to the box body, an accommodated object is pushed by using the lifting member, so that one end portion of the accommodated object is away from the base plate of the box body compared with the other end portion of the accommodated object. Therefore, the accommodated object is gradually inclined from a state of being parallel to the base plate to protrude from the box body, thereby making it convenient for a user to pick the accommodated object from the packaging box.

DETAILED DESCRIPTION OF THE EMBODIMENTS

Figure 1:
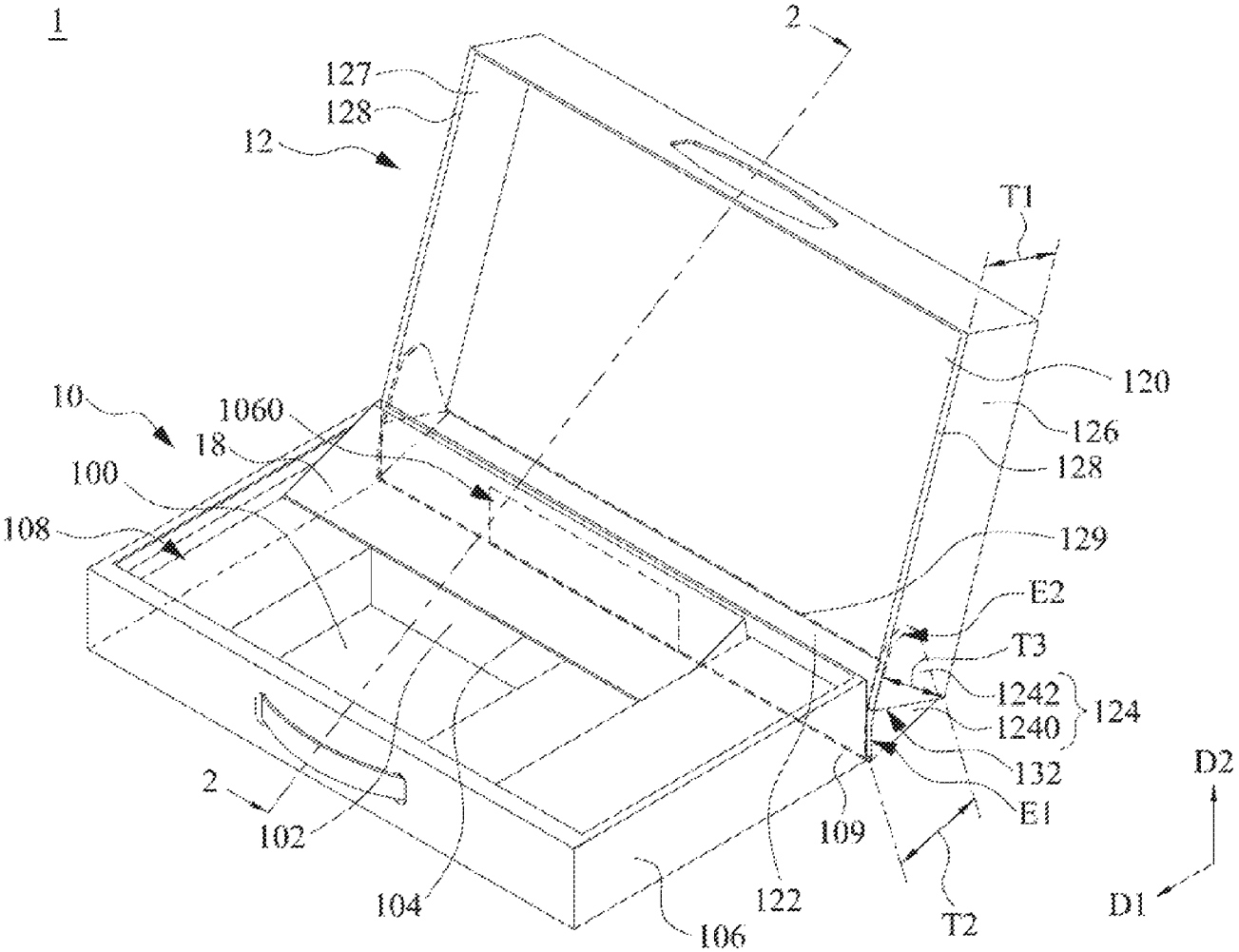
FIG. 1 is a three-dimensional diagram of a packaging box according to an embodiment of this disclosure.
Figure 2A:
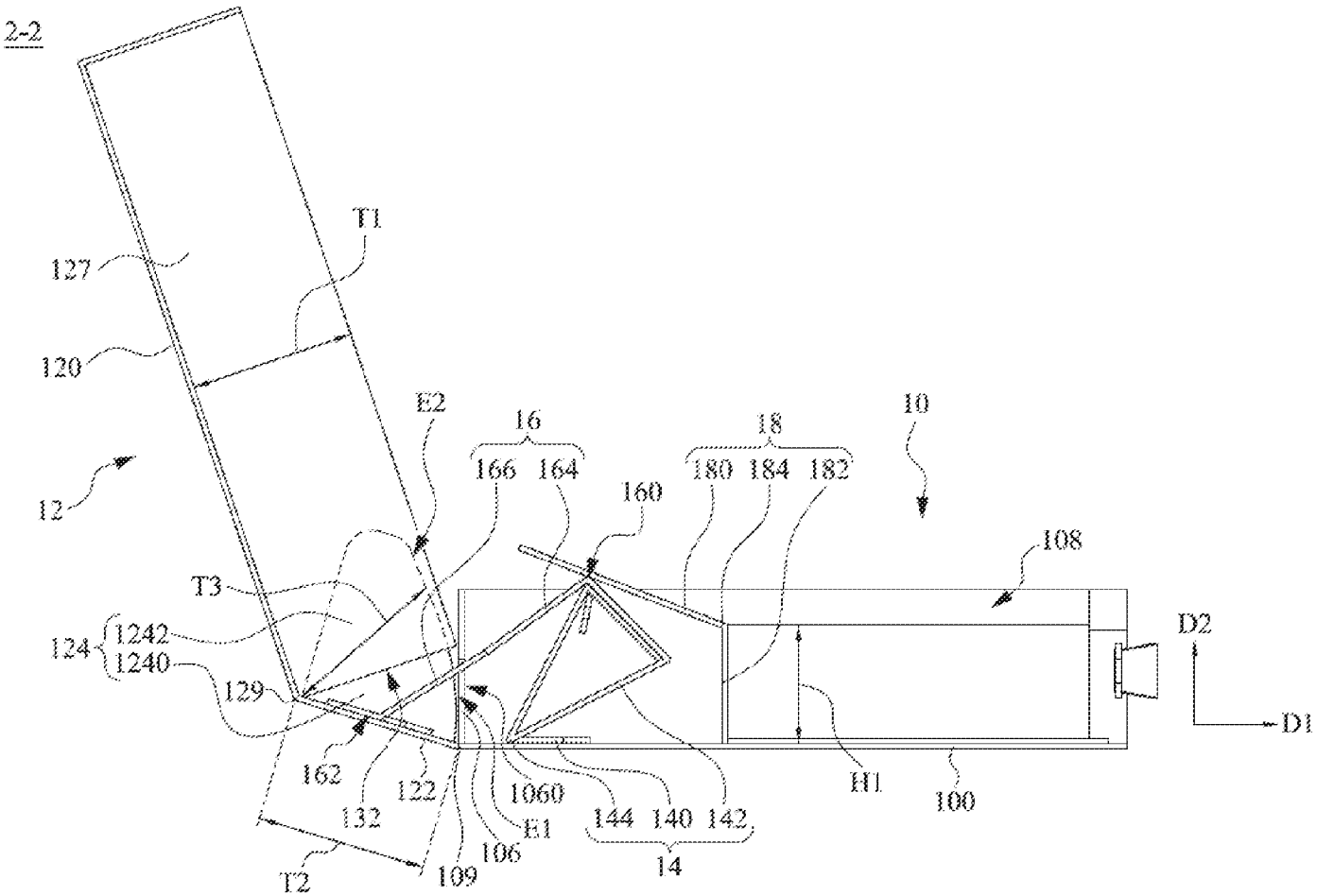
FIG. 2A is a sectional view of a packaging box along line 2-2 in FIG. 1 according to an embodiment of this disclosure, where a pressing member in FIG. 2A is connected to a base plate of a box body.
Figure 2B:
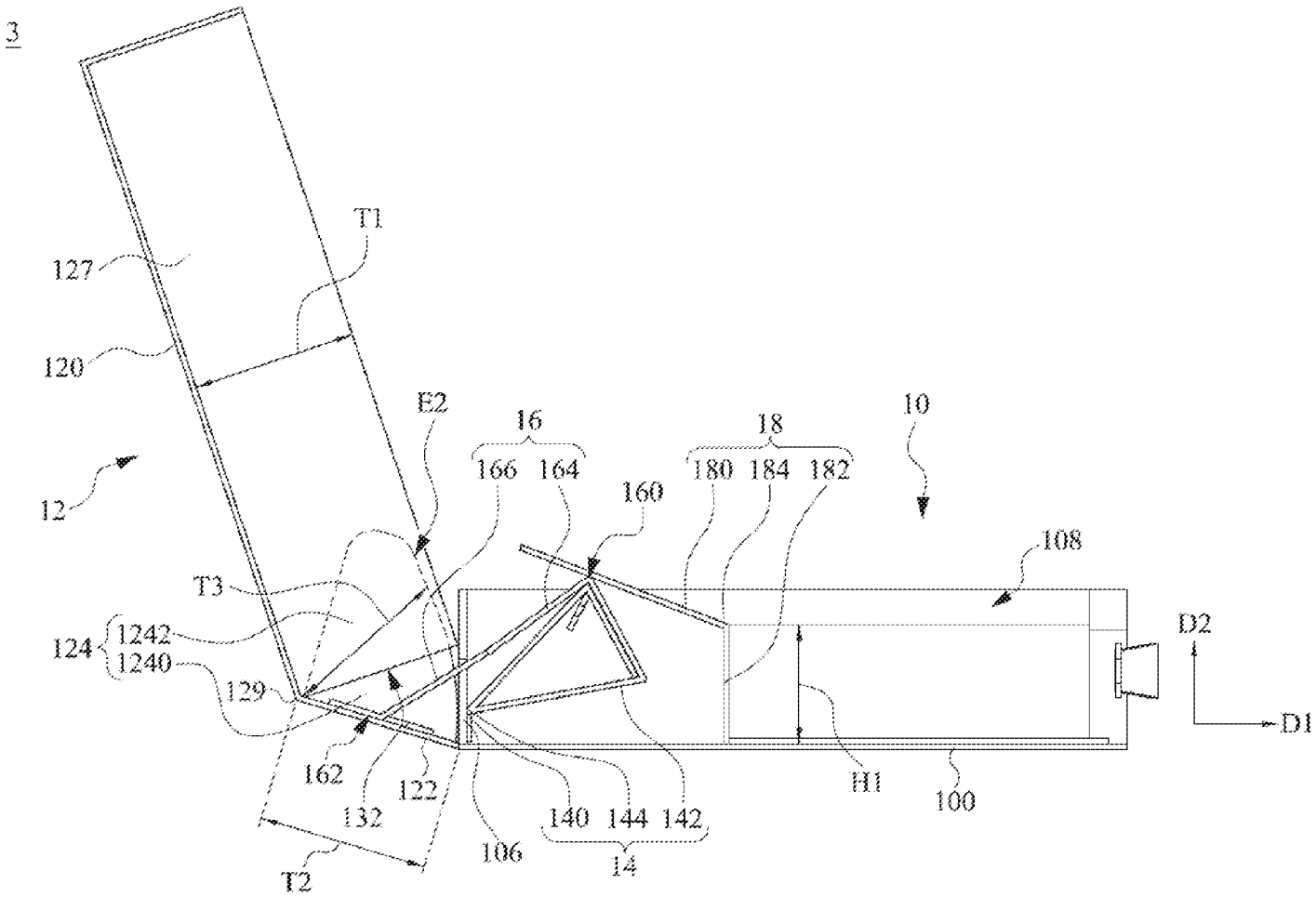
FIG. 2B and FIG. 2C each are a sectional view of a packaging box along the line 2-2 shown in FIG. 1 according to another embodiment of this disclosure.
Figure 2C:
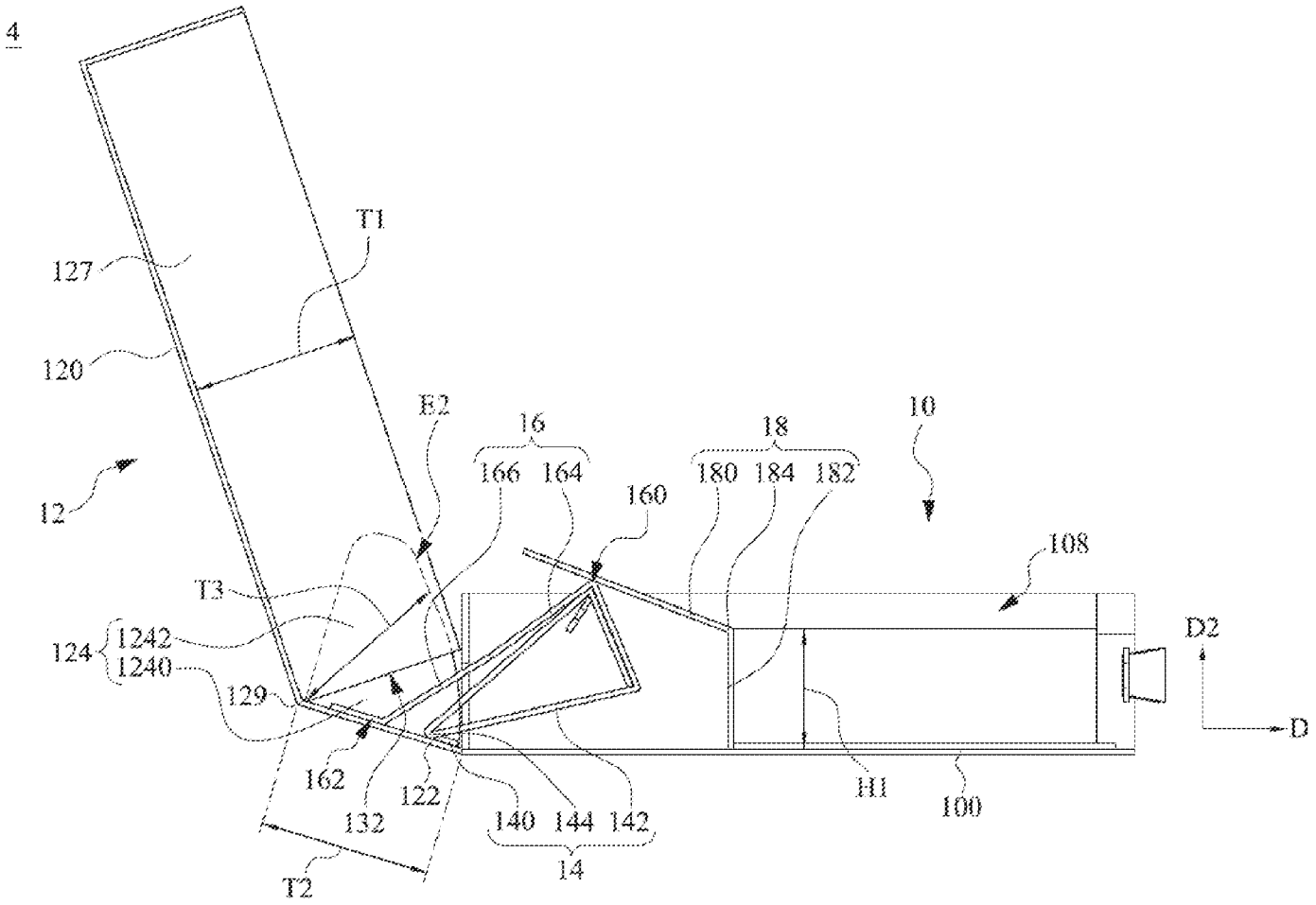
Figure 3:
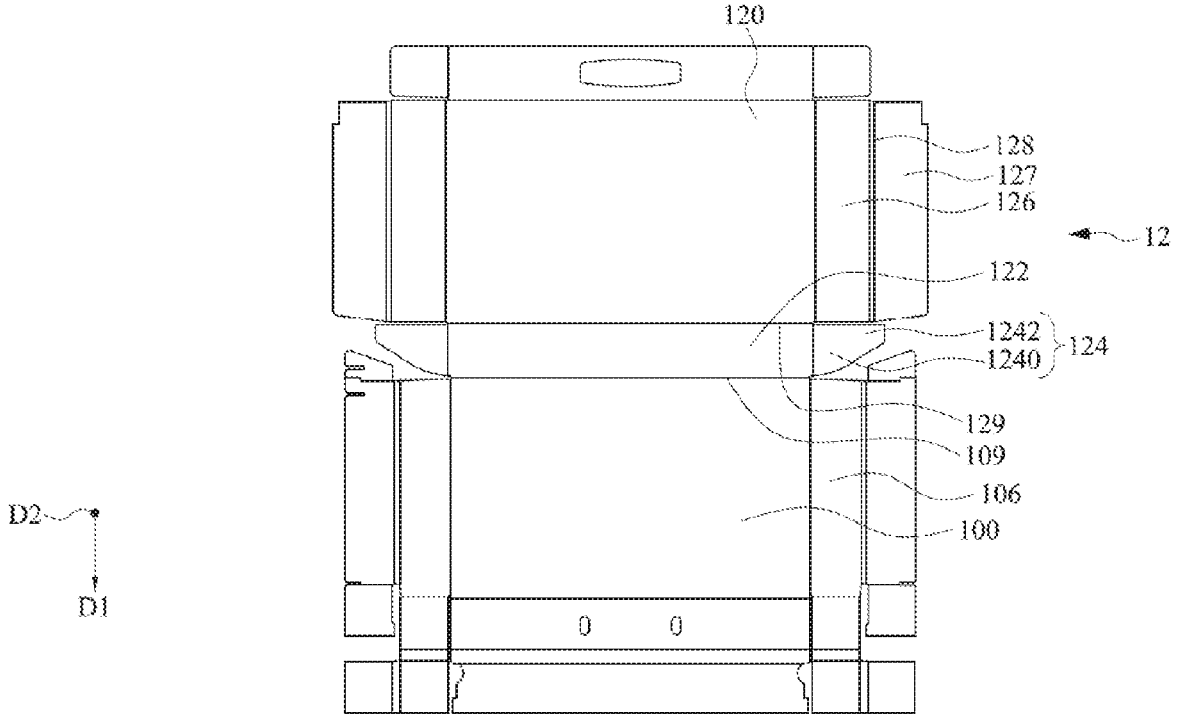
FIG. 3 is a planar expanded view of a part of a packaging box according to an embodiment of this disclosure.
Figure 4:
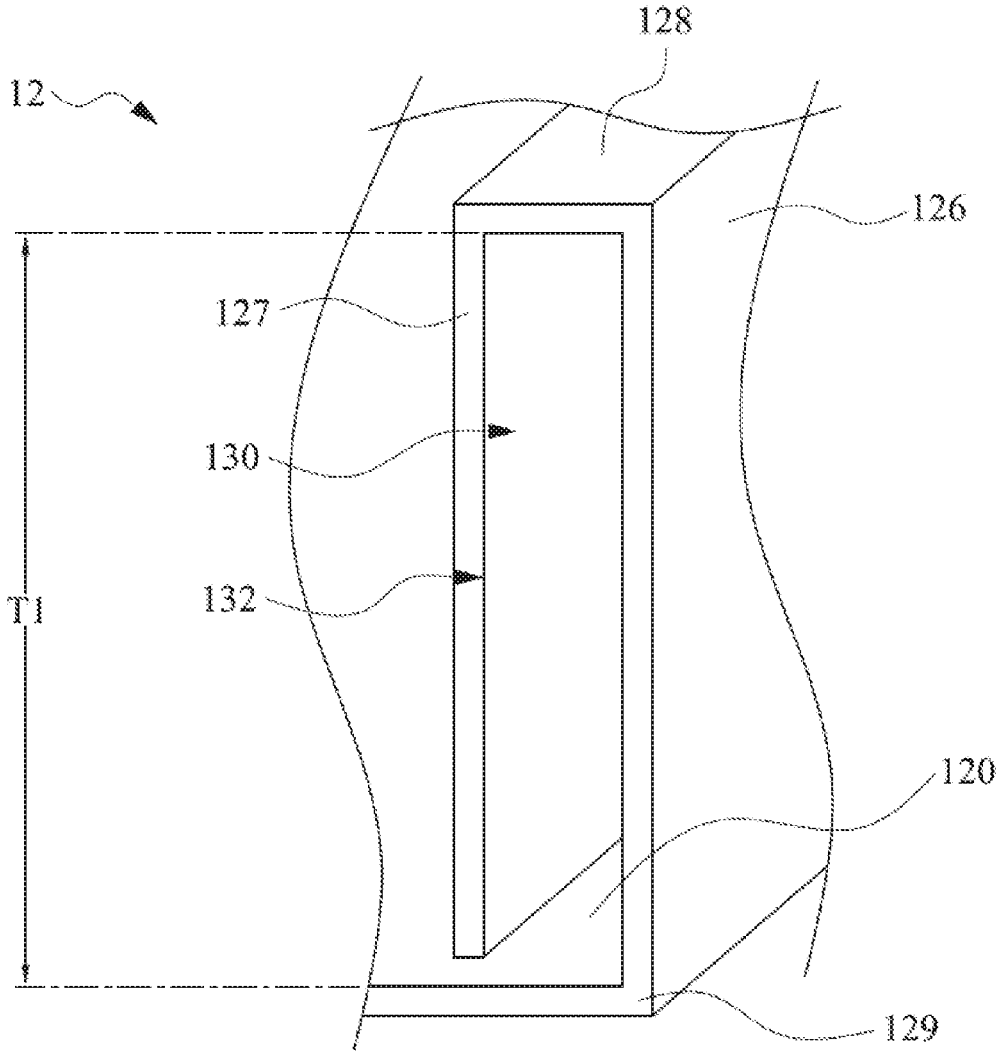
FIG. 4 is a partial three-dimensional diagram of a cover body according to an embodiment of this disclosure.

Refer to FIG. 1 and FIG. 2A as well as FIG. 3 and FIG. 4. As shown in FIG. 1 to FIG. 4, in an embodiment, a packaging box 1 includes a box body 10, a cover body 12, a pressing member 14 (as shown in FIG. 2A), a linkage member 16 (as shown in FIG. 2A), and a lifting member 18 (as shown in FIG. 2A).

In FIG. 1 and FIG. 2A, the box body 10 includes a base plate 100 (as shown in FIG. 2A) and a first side wall 106. In this embodiment, the base plate 100 of the box body 10 is defined a first direction D1 and a second direction D2. The first direction D1 is parallel to the base plate 100 of the box body 10, and the second direction D2 is perpendicular to the first direction D1. The first side wall 106 of the box body 10 is perpendicular to and surrounds the base plate 100 to form an accommodation space 108 and includes a limiting hole 1060. Specifically, the limiting hole 1060 is provided in the first side wall 106 located between a second side wall 122 of the cover body 12 and the base plate 100. In an embodiment, the cover body 12 is configured to be closed or opened relative to the box body 10.

Refer to FIG. 2A. In an embodiment, the lifting member 18 is connected with the box body 10 and is located above the pressing member 14. Specifically, the lifting member 18 includes a lifting plate 180 and a support wall 182. The support wall 182 of the lifting member 18 is perpendicular and connected to the base plate 100. An end portion of the support wall 182 away from the base plate 100 includes a rotating shaft 184. The lifting plate 180 of the lifting member 18 is connected to the rotating shaft 184. The lifting plate 180 rotates relative to the support wall 182 based on the rotating shaft 184. The lifting plate 180 is located above the pressing member 14. In an embodiment, the rotating shaft 184 is a crease on the lifting member 18. However, this disclosure is not limited thereto. In other embodiments, the rotating shaft 184 is alternatively a groove in the lifting member 18.

Refer to FIG. 3. The cover body 12 includes a cover plate 120, a second side wall 122, a limiting side plate 124, a third side wall 126, a stop portion 128, and a fourth side wall 127. The second side wall 122 is connected between the cover plate 120 of the cover body 12 and the base plate 100 of the box body 10. The second side wall 122 is rotatably connected to the base plate 100 of the box body 10 by a rotating shaft 109. The cover plate 120 of the cover body 12 is rotatably connected to one side of the second side wall 122 of the cover body 12 away from the base plate 100 by a rotating shaft 129. In an embodiment, the rotating shaft 109 or the rotating shaft 129 is a crease on the cover body 12. However, this disclosure is not limited thereto. In other embodiments, the rotating shaft 109 or the rotating shaft 129 is alternatively a groove in the cover body 12.

In an embodiment, the base plate 100 of the box body 10, a part of the first side wall 106, the cover plate 120 of the cover body 12, the second side wall 122, the limiting side plate 124, the third side wall 126 and the stop portion 128 are made of a same sheet material, among which every two adjacent parts are distinguished and foldable relative to each other by a junction with a crease therebetween. However, this disclosure is not limited thereto. In other embodiments, any feature enabling the two adjacent parts to be foldable relative to each other by the junction therebetween is applicable to this disclosure.

Refer to FIG. 4. In an embodiment, the third side wall 126 of the cover body 12 is connected with two opposite edges (as shown in FIG. 1) of the cover plate 120. The third side wall 126 is extends toward the box body 10 from the edges of the cover plate 120. In FIG. 4, the stop portion 128 of the cover body 12 is connected with one end of the third side wall 126 away from the cover plate 120. The stop portion 128 and the cover plate 120 are parallel to each other and a first distance T1 is between the stop portion 128 and the cover plate 120. The fourth side wall 127 of the cover body 12 is connected with one side of the stop portion 128 opposite to the third side wall 126. In an embodiment, the fourth side wall 127, the stop portion 128, the third side wall 126 and the cover plate 120 are configured in sequence to be folded perpendicularly to each other. Therefore, the fourth side wall 127 of the cover body 12 is parallel to the third side wall 126. In this embodiment, the fourth side wall 127, the stop portion 128 and the third side wall 126 of the cover body 12 form a slot 130. The slot 130 has an opening 132 facing toward the second side wall 122. An aperture of the slot 130 is the first distance T1 in a direction perpendicular to the cover plate 120.

Refer to FIG. 1 and FIG. 2A. In an embodiment, the limiting side plate 124 of the cover body 12 protrudes from the second side wall 122. The limiting side plate 124 includes a first portion 1240 and a second portion 1242. The limiting side plate 124 is at least partially accommodated in the slot 130. The first portion 1240 of the limiting side plate 124 is adjacent to the second side wall 122. The first portion 1240 has a first edge E1. In an embodiment, a second distance T2 is between the first edge E1 and the rotating shaft 129, and the second distance T2 is equal to the first distance T1 between the stop portion 128 (as shown in FIG. 1) of the cover body 12 and the cover plate 120. However, this disclosure is not limited thereto. In other embodiments, the second distance T2 between the first edge E1 and the rotating shaft 129 is less than the first distance T1 between the stop portion 128 and the cover plate 120.

In an embodiment, the second portion 1242 of the limiting side plate 124 is connected with one side of the first portion 1240 opposite to the second side wall 122. The second portion 1242 has a second edge E2. A third distance T3 is between at least one point on the second edge E2 and the rotating shaft 129. The third distance T3 is greater than the first distance T1 between the stop portion 128 and the cover plate 120.

Figure 5A:
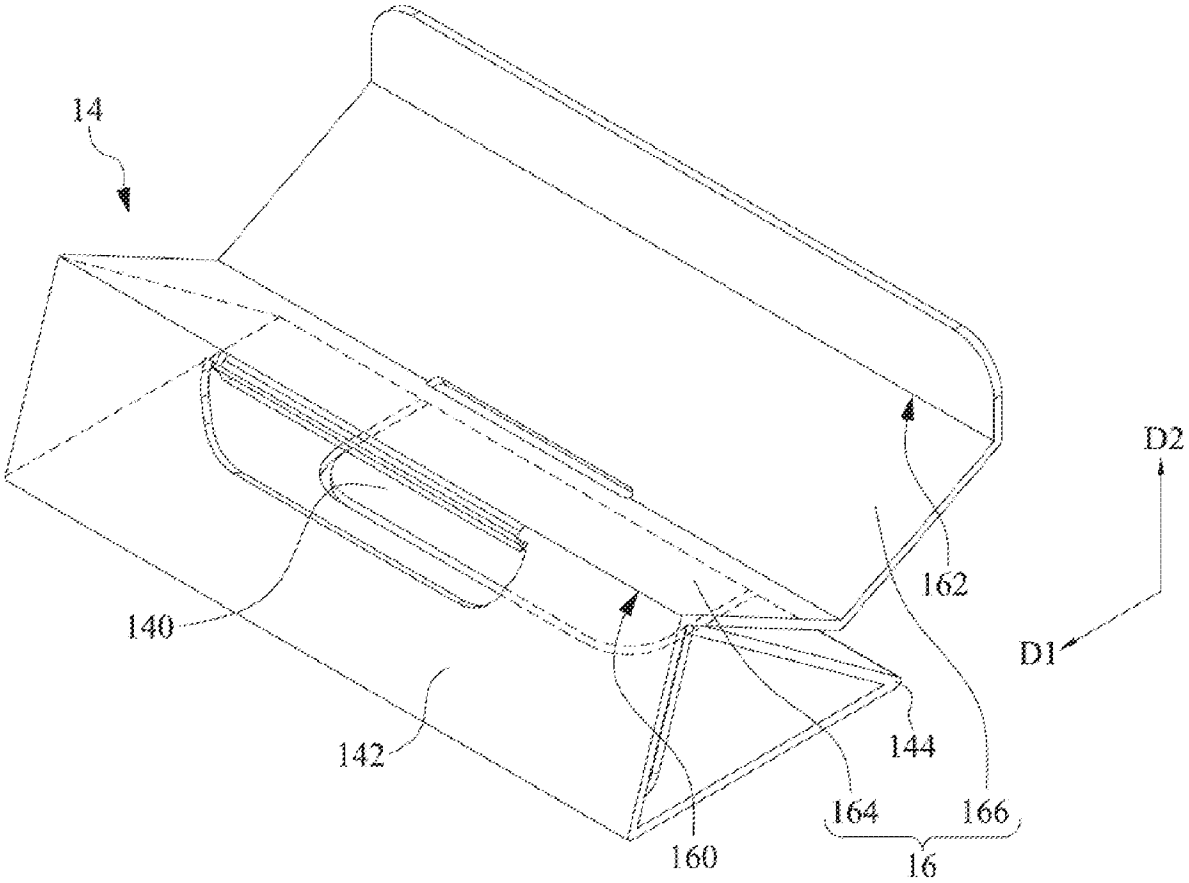
FIG. 5A is a three-dimensional diagram of a pressing member and a linkage member according to an embodiment of this disclosure.
Figure 5B:
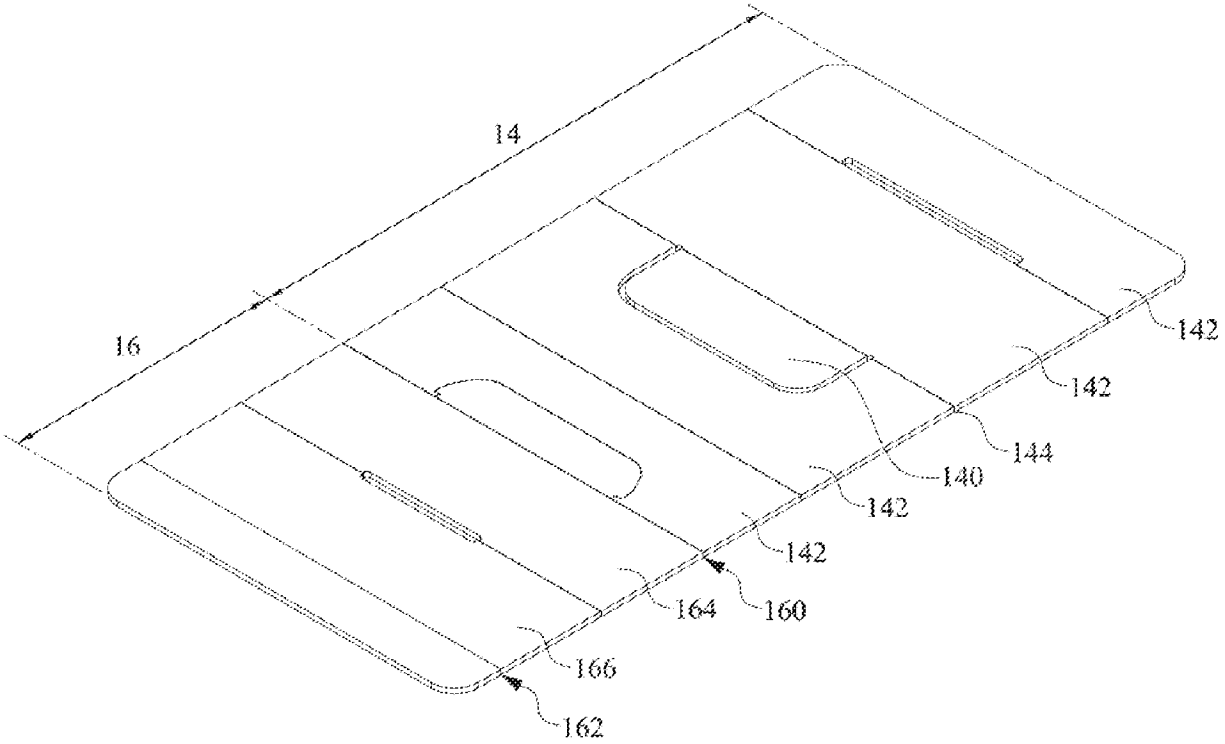
FIG. 5B is a planar expanded view of FIG. 5A.

Refer to FIG. 2A to FIG. 2C, and FIG. 5A and FIG. 5B. FIG. 2B and FIG. 2C are sectional views of a packaging box 3 and a packaging box 4 respectively along the line 2-2 shown in FIG. 1 according to another embodiment of this disclosure. In FIG. 2A, the pressing member 14 of the packaging box 1 is connected with the base plate 100 of the box body 10 and is located in the box body 10. A difference between FIG. 2B and FIG. 2A lies in that a pressing member 14 of the packaging box 3 in FIG. 2B is connected with a first side wall 106 of a box body 10. A difference between FIG. 2C and FIG. 2A lies in that a pressing member 14 of the packaging box 4 in FIG. 2C is connected with a second side wall 122 of a cover body 12. FIG. 5A is a three-dimensional diagram of a pressing member 14 and a linkage member 16 according to an embodiment of this disclosure. FIG. 5B is a planar expanded view of FIG. 5A.

As shown in FIG. 2A, FIG. 5A, and FIG. 5B, in an embodiment, the pressing member 14 includes a fixed portion 140 and a rotating portion 142. The rotating portion 142 is rotatably connected with the fixed portion 140. In an embodiment, the pressing member 14 further includes a bent portion 144, and the rotating portion 142 of the pressing member 14 is rotatably connected with the fixed portion 140 by the bent portion 144. The fixed portion 140 of the pressing member 14 is connected with the base plate 100 of the box body 10. In an embodiment, as shown in FIG. 2B, the fixed portion 140 of the pressing member 14 is connected with the first side wall 106 of the box body 10. In an embodiment, as shown in FIG. 2C, the fixed portion 140 of the pressing member 14 is connected with the second side wall 122 of the cover body 12. However, this disclosure is not limited thereto.

As shown in FIG. 2A, FIG. 5A, and FIG. 5B, in an embodiment, the linkage member 16 includes a first linkage segment 164 and a second linkage segment 166 connected with each other. The first linkage segment 164 includes a first end portion 160. The second linkage segment 166 includes a second end portion 162. In FIG. 2A, the linkage member 16 is connected between the pressing member 14 and the cover body 12. Specifically, the first end portion 160 of the linkage member 16 is connected with the rotating portion 142 of the pressing member 14. The second end portion 162 of the linkage member 16 is connected with the cover body 12. In an embodiment, the first side wall 106 includes the limiting hole 1060, and the second end portion 162 of the linkage member 16 passes through the limiting hole 1060 to connect with the second side wall 122 of the cover body 12.

In addition, refer to FIG. 5B. In an embodiment, the fixed portion 140, the rotating portion 142 and the bent portion 144 of the pressing member 14 and the first linkage segment 164 and the second linkage segment 166 of the linkage member 16 are made of a same sheet material, among which every two adjacent parts are distinguished and foldable relative to each other by a junction with a crease therebetween. However, this disclosure is not limited thereto. In other embodiments, any feature enabling the two adjacent parts to be foldable relative to each other by the junction therebetween is applicable to this disclosure.

Figure 6A:
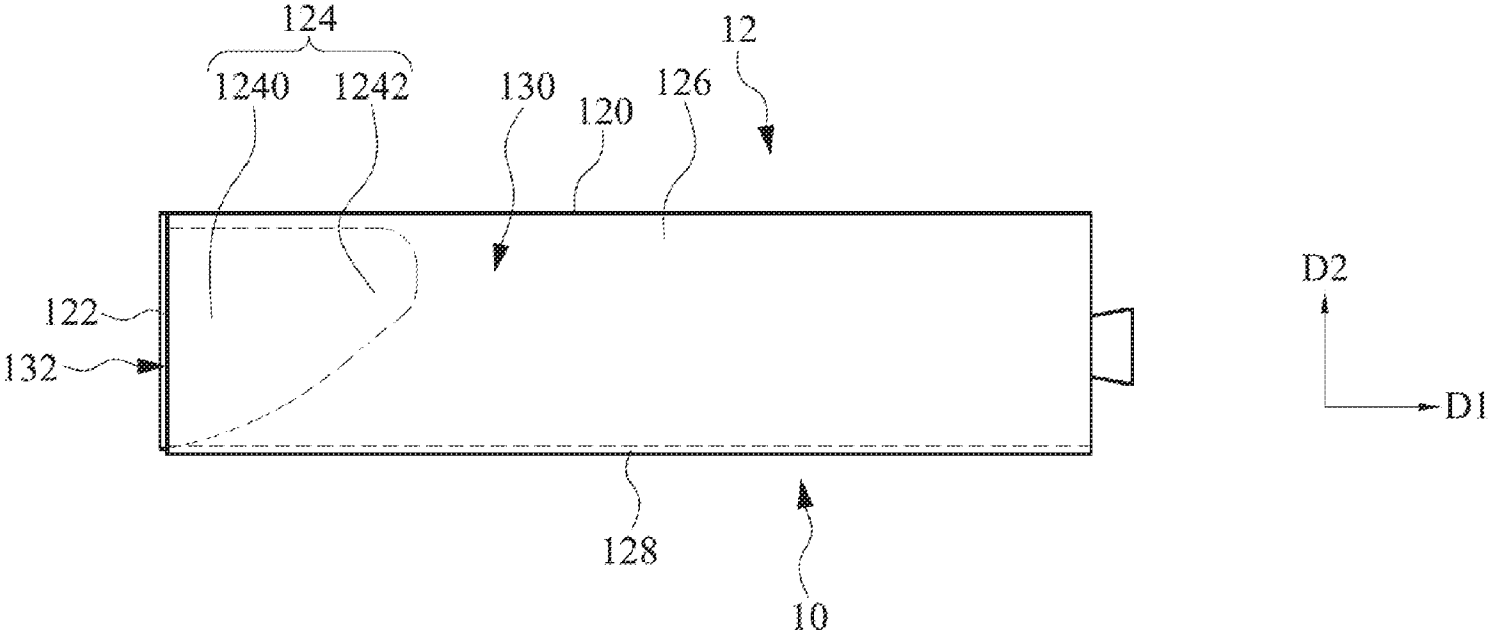
FIG. 6A and FIG. 7A each are a side view of a packaging box according to an embodiment of this disclosure, where a cover body is closed relative to a box body in FIG. 6A, and a cover body is opened by a first angle relative to a box body in FIG. 7A.

Refer to FIG. 6A to FIG. 9. In an embodiment, an accommodated object 2 is an electronic device. However, this disclosure is not limited thereto. In other embodiments, any suitable accommodated object 2 is applicable to this disclosure. In FIG. 6A and FIG. 6B, the cover body 12 is closed relative to the box body 10. As shown in FIG. 6A, in an embodiment, the limiting side plate 124 protruding from the second side wall 122 extends into the slot 130 (as shown in FIG. 4) from the opening 132. The first portion 1240 and the second portion 1242 of the limiting side plate 124 are both accommodated in the slot 130 and are located between the cover plate 120 and the stop portion 128.

Figure 6B:
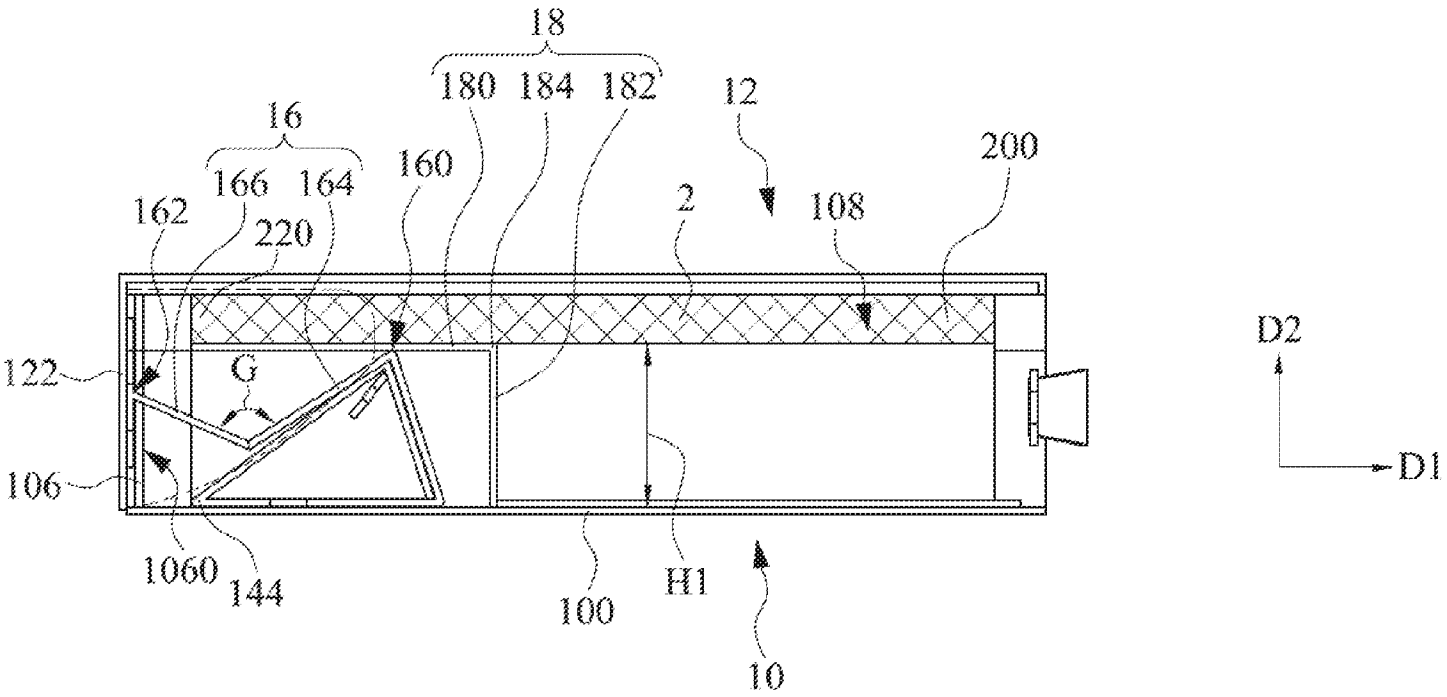
FIG. 6B and FIG. 7B each are a sectional view of a packaging box accommodating an accommodated object along the line 2-2 shown in FIG. 1 according to an embodiment of this disclosure, where a cover body is closed relative to a box body in FIG. 6B, and a cover body is opened by a first angle relative to a box body in FIG. 7B.

As shown in FIG. 6B, in the first direction D1, a vertical projection position of the bent portion 144 of the pressing member 14 on a virtual extension plane of the base plate 100 is located between the vertical projection positions of the first end portion 160 and the second end portion 162 of the linkage member 16 on the virtual extension plane of the base plate 100. An angle G exists between the first linkage segment 164 and the second linkage segment 166 of the linkage member 16. The second side wall 122 of the cover body 12 is in close contact with the first side wall 106 of the box body 10. When at least one part of the lifting plate 180 is not pushed by the pressing member 14, the lifting plate 180 of the lifting member 18 is parallel to the base plate 100 of the box body 10. The lifting plate 180 has a first height H1 relative to the base plate 100 of the box body 10. That is, a distance between the base plate 100 and a position at which the lifting plate 180 is connected with the pressing member 14 is equal to the first height H1 between the rotating shaft 184 of the support wall 182 and the base plate 100.

In an embodiment, the accommodated object 2 is accommodated in the accommodation space 108 of the box body 10. The accommodated object 2 is in close contact with a surface of the lifting plate 180 of the lifting member 18 and is parallel to the base plate 100. In addition, the accommodated object 2 includes a first end portion 200 and a second end portion 220 opposite to each other. The first end portion 200 and the second end portion 220 are respectively located on two opposite sides of the rotating shaft 184. In this embodiment, a distance between the first end portion 200 of the accommodated object 2 and the base plate 100 is equal to a distance between the second end portion 220 of the accommodated object 2 and the base plate 100 (that is, the first height H1).

Figure 7A:
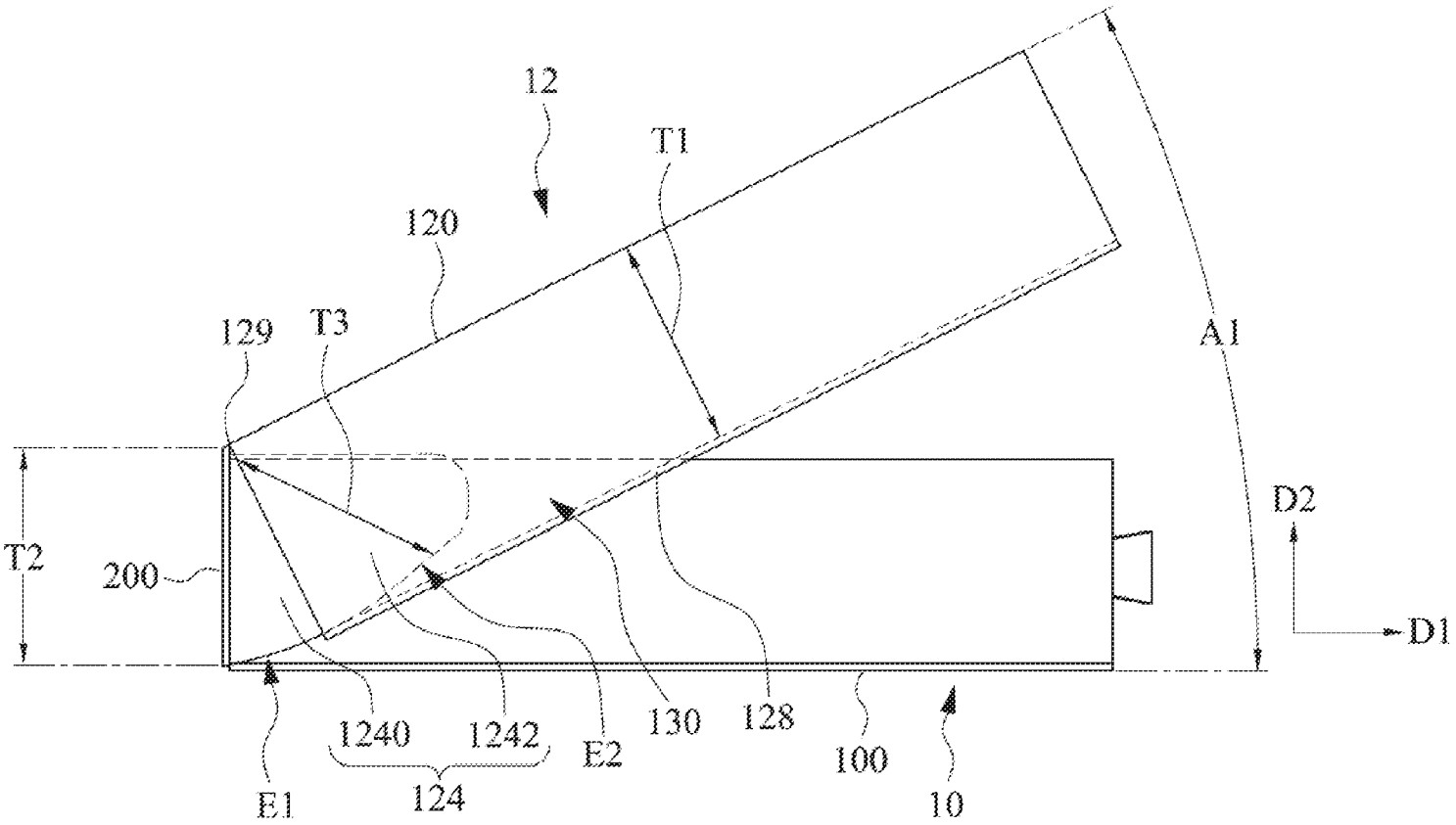
Figure 7B:
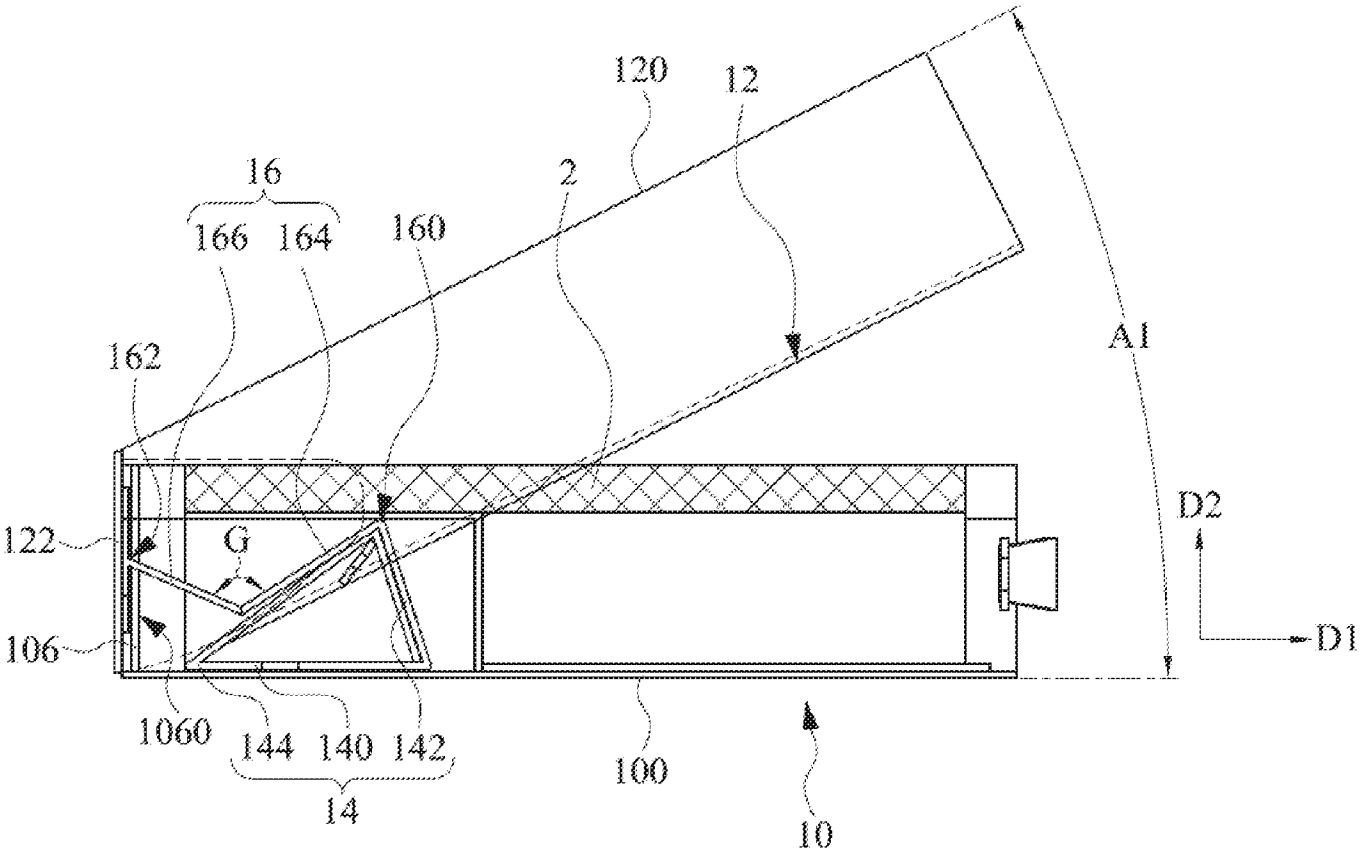

Then, in FIG. 7A and FIG. 7B, the cover body 12 is opened relative to the box body 10. A first angle A1 exists between a virtual extension plane of the cover plate 120 of the cover body 12 and a virtual extension plane of the base plate 100 of the box body 10. As shown in FIG. 7A, in an embodiment, when the cover plate 120 of the cover body 12 is rotated around the rotating shaft 129 and gradually away from the base plate 100, the stop portion 128 of the cover body 12 is rotated around the rotating shaft 129 and gradually away from the second side wall 122. In an embodiment, the second distance T2 between the first edge E1 of the first portion 1240 of the limiting side plate 124 and the rotating shaft 129 is less than the aperture of the slot 130 (as shown in FIG. 4). The third distance T3 between the rotating shaft 129 and the at least one point on the second edge E2 of the second portion 1242 is greater than the aperture of the slot 130. Therefore, the stop portion 128 of the cover body 12 is not limited by the first edge E1 of the first portion 1240 in the limiting side plate 124. Therefore, the cover plate 120 is rotated around the rotating shaft 129 and gradually away from the base plate 100 till the stop portion 128 is in contact with the second edge E2 of the second portion 1242.

Further, because the third distance T3 between the at least one point on the second edge E2 of the second portion 1242 and the rotating shaft 129 is greater than the aperture of the slot 130, the stop portion 128 is stopped by the second edge E2 of the second portion 1242. Therefore, the stop portion 128 cannot continue to rotate around the rotating shaft 129 toward a direction away from the second side wall 122. In this case, a maximum angle exists between the cover plate 120 and the second side wall 122. The first portion 1240 of the limiting side plate 124 is exposed outside the slot 130 of the cover body 12. The second portion 1242 of the limiting side plate 124 is accommodated in the slot 130.

As shown in FIG. 7B, a vertical projection of the bent portion 144 of the pressing member 14 on the virtual extension plane of the base plate 100 remains between the vertical projections of the first end portion 160 and the second end portion 162 of the linkage member 16 on the virtual extension plane of the base plate 100. The angle G between the first linkage segment 164 and the second linkage segment 166 of the linkage member 16 is constant. The second side wall 122 of the cover body 12 remains in close contact with the first side wall 106 of the box body 10.

Figure 8:
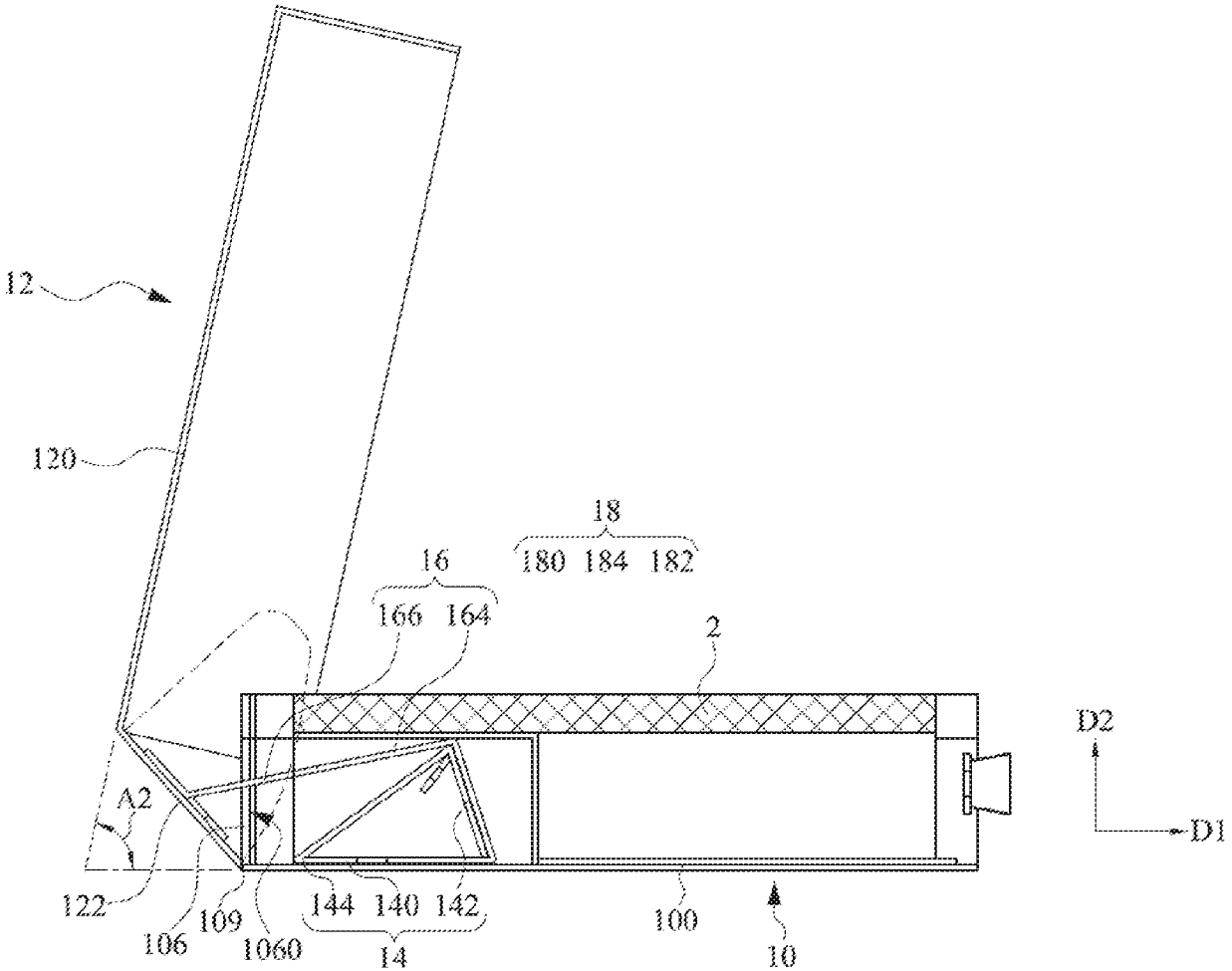
FIG. 8 and FIG. 9 each are a sectional view of a packaging box accommodating an accommodated object along the line 2-2 shown in FIG. 1 according to an embodiment of this disclosure, where a cover body is opened by a second angle relative to a box body in FIG. 8, and a cover body is opened by a third angle relative to a box body in FIG. 9.

Then, in FIG. 8, the cover body 12 is continuously opened relative to the box body 10. A second angle A2 exists between a virtual extension plane of the cover plate 120 of the cover body 12 and the virtual extension plane of the base plate 100 of the box body 10. The second angle A2 is greater than the first angle A1 shown in FIG. 7A and FIG. 7B. In this case, because the stop portion 128 (as shown in FIG. 7A) is limited by the second edge E2 of the second portion 1242, the position relationship between the cover plate 120 and the second side wall 122 is constant. In addition, when the cover body 12 rotates around the rotating shaft 109 to open relative to the box body 10, the second side wall 122 drives and stretches the linkage member 16. Therefore, the first linkage segment 164 and the second linkage segment 166 of the linkage member 16 that originally form the angle G shown in FIG. 7B gradually move to lie in a same plane.

Figure 9:
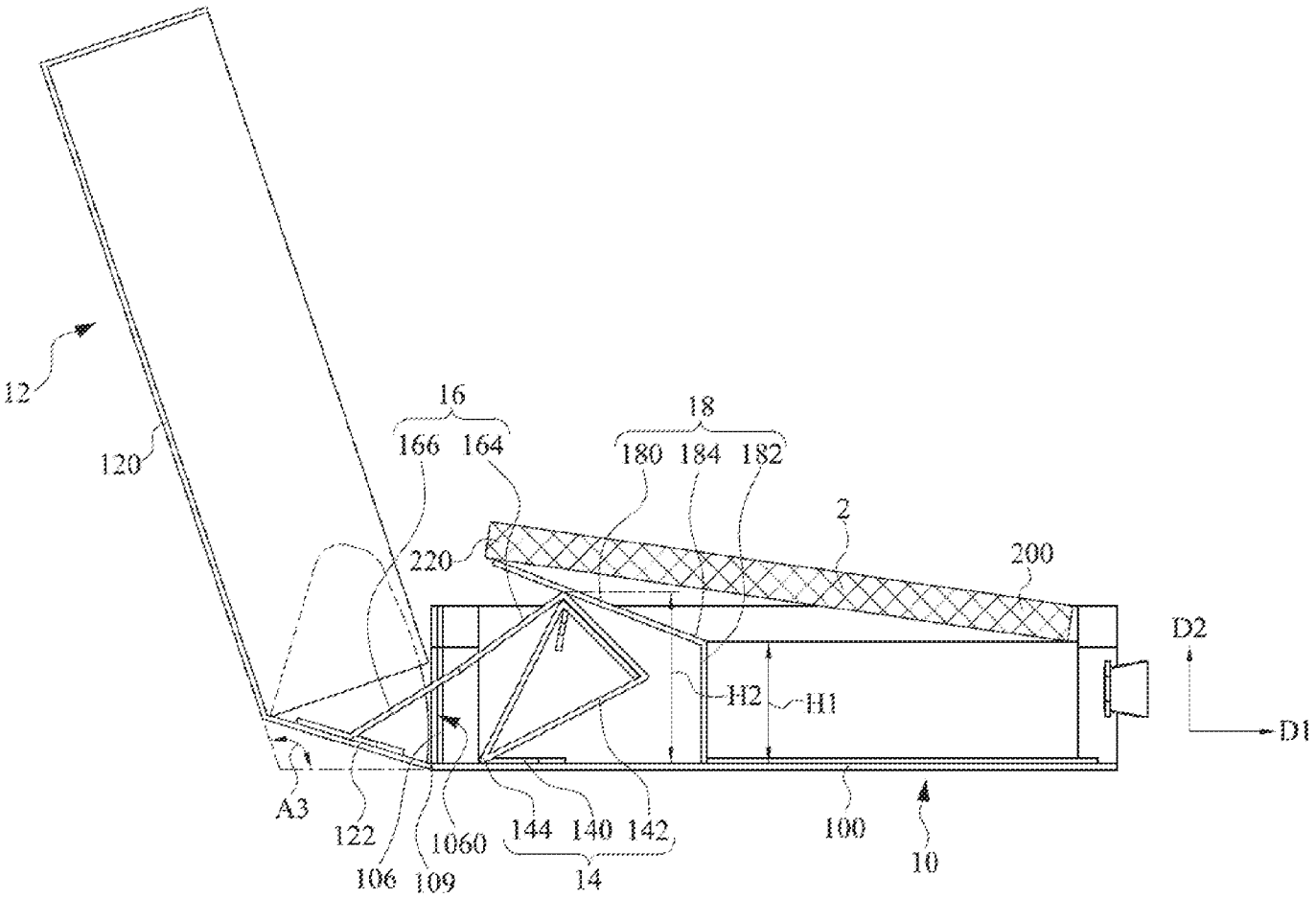

Then, in FIG. 9, the cover body 12 is continuously opened relative to the box body 10. A third angle A3 exists between the virtual extension plane of the cover plate 120 of the cover body 12 and the virtual extension plane of the base plate 100 of the box body 10. The third angle A3 is greater than the second angle A2 shown in FIG. 8. In this case, the linkage member 16 is continuously driven and stretched by the second side wall 122, so that the first linkage segment 164 and the second linkage segment 166 of the linkage member 16 remain in a same plane. In addition, when the cover body 12 rotates around the rotating shaft 109 to open relative to the box body 10, the linkage member 16 moves with the cover body 12 to drive the rotating portion 142 of the pressing member 14 to rotate, so that at least one part of the lifting plate 180 is pushed by the rotating portion 142 of the pressing member 14 to move away from the base plate 100 of the box body 10. Specifically, the lifting plate 180 of the lifting member 18 rotates around the rotating shaft 184 of the support wall 182 toward a direction away from the base plate 100. After at least one part of the lifting member 18 is pushed by the pressing member 14 to move away from the base plate 100, the first linkage segment 164 and the second linkage segment 166 are located in a plane. In this case, the distance between the position at which the lifting plate 180 is connected to the pressing member 14 and the base plate 100 is a second height H2. The second height H2 is greater than the first height H1. In this way, when the cover body 12 rotates round the rotating shaft 109 to open relative to the box body 10, a distance between the first end portion 200 of the accommodated object 2 and the base plate 100 maintains the first height H1. The second end portion 220 of the accommodated object 2 is pushed by the lifting plate 180 of the lifting member 18 to move away from the base plate 100 of the box body 10. Therefore, the distance between the second end portion 220 and the base plate 100 is greater than the first height H1. Therefore, the accommodated object 2 is gradually inclined relative to the base plate 100 from a state of being parallel to the base plate 100, so that the second end portion 220 protrudes from the box body 10, thereby making it convenient for a user to pick the accommodated object 2 from the packaging box 1.

In an embodiment, when the second side wall 122 of the cover body 12 rotates around the rotating shaft 109 toward a direction away from the first side wall 106 of the box body 10, the second side wall 122 drives the linkage member 16 to move in the limiting hole 1060 of the first side wall 106. Specifically, as shown in FIG. 6A to FIG. 8, when the cover body 12 is opened to the first position relative to the box body 10, a distance exists between the linkage member 16 and an upper edge of the limiting hole 1060 (as shown in FIG. 1) of the first side wall 106. In an embodiment, the first position is defined as a state when an angle between the virtual extension plane of the cover plate 120 of the packaging box 1 and the virtual extension plane of the base plate 100 is less than the third angle A3 shown in FIG. 9.

Refer FIG. 1 to FIG. 9. When the cover body 12 is continuously opened to a second position from the first position relative to the box body 10, the linkage member 16 abuts against the upper edge of the limiting hole 1060 of the first side wall 106. In an embodiment, the second position is defined as a state when an angle between the virtual extension plane of the cover plate 120 of the packaging box 1 and a virtual extension plane of the base plate 100 is equal to the third angle A3. In this case, the linkage member 16 is stopped by the upper edge of the limiting hole 1060 in the first side wall 106, so that the second side wall 122 of the cover body 12 cannot continuously drive and stretch the linkage member 16, and the rotating portion 142 of the pressing member 14 stops rotating.

In addition, the second side wall 122 cannot continuously rotate around the rotating shaft 109 toward a direction away from the first side wall 106. In this case, a maximum angle exists between the second side wall 122 of the cover body 12 and the base plate 100 of the box body 10. In this embodiment, a moving range of the linkage member 16 is limited by the limiting hole 1060 in the first side wall 106, thereby controlling a range of an angle by which the cover body 12 is opened relative to the box body 10. In addition, the linkage member 16 abuts against the upper edge of the limiting hole 1060 of the box body 10, and the box body 10 provides a support force for the cover body 12, so that the cover body 12 does not continuously rotate around the rotating shaft 109 in a direction away from the box body 10.

As is clearly learned from the above detailed description of the specific embodiments of this disclosure, in this implementation, during opening of the cover body relative to the box body, the accommodated object is pushed by using the lifting member, so that the second end portion of the accommodated object is away from the base plate of the box body compared with the first end portion of the accommodated object. Therefore, the accommodated object is gradually inclined from the state of being parallel to the base plate to protrude from the box body, thereby making it convenient for the user to pick the accommodated object from the packaging box. In addition, the moving range of the linkage member is limited by the limiting hole on the first side wall, thereby controlling the range of the angle by which the cover body is opened relative to the box body. Furthermore, the linkage member abuts against the upper edge of the limiting hole of the box body, and the box body provides the support force for the cover body, so that the cover body does not further rotate around the rotating shaft in the direction away from the box body.

Although the invention is disclosed above by using the embodiments, the embodiments are not intended to limit the invention. A person skilled in the art can make some variations or modifications without departing from the spirit and scope of the invention. Therefore, the protection scope of the invention should be subject to the appended claims.

What is claimed is:

1. A packaging box, comprising:

a box body, comprising a base plate and a first side wall that is perpendicular to and surrounds the base plate and has a limiting hole thereon;

a cover body, configured to be closed or opened relative to the box body and comprising a cover plate and a second side wall connected between the cover plate and the base plate;

a pressing member, connected with the box body or the cover body and located in the box body;

a linkage member, connected between the pressing member and the cover body and configured to pass through the limiting hole of the first side wall to connect between the pressing member and the second side wall of the cover body; and a lifting member, connected with the box body and located above the pressing member, wherein when the cover body is closed relative to the box body, the second side wall is in close contact with the first side wall, and when the cover body is opened relative to the box body, the second side wall rotates relative to the first side wall to drive the linkage member to move in the limiting hole, and the linkage member moves with the cover body to drive the pressing member to press against the lifting member, so that at least one part of the lifting member is pushed by the pressing member to move away from the base plate.

2. The packaging box according to claim 1, wherein the pressing member comprises a fixed portion and a rotating portion, the fixed portion is connected with the box body or the cover body, and the rotating portion is connected with the fixed portion, wherein when the cover body is opened relative to the box body, the linkage member moves with the cover body to drive the rotating portion to rotate, so that at least one part of the lifting member is pushed by the rotating portion to move away from the base plate.

3. The packaging box according to claim 1, wherein the lifting member comprises a lifting plate and a support wall, the support wall is connected with the base plate, an end portion of the support wall away from the base plate comprises a rotating shaft, and the lifting plate is connected with the support wall by using the rotating shaft.

4. The packaging box according to claim 3, wherein when at least one part of the lifting plate is not pushed by the pressing member, the lifting plate has a first height relative to the base plate; and when at least one part of the lifting plate is pushed by the pressing member to move away from the base plate, the lifting plate has a second height relative to the base plate, and the second height is greater than the first height.

5. The packaging box according to claim 2, wherein the pressing member comprises a bent portion, and the rotating portion is connected to the fixed portion by the bent portion.

6. The packaging box according to claim 2, wherein the linkage member comprises a first end portion and a second end portion, the first end portion is connected with the rotating portion, and the second end portion is connected with the cover body.

7. The packaging box according to claim 1, wherein the linkage member comprises a first linkage segment and a second linkage segment connected with each other, when the cover body is closed to the box body, an angle exists between the first linkage segment and the second linkage segment, and after the at least one part of the lifting member is pushed by the pressing member to move away from the base plate, the first linkage segment and the second linkage segment are located in a same plane.

8. The packaging box according to claim 1, wherein when the cover body is opened to a first position relative to the box body, a distance exists between the linkage member and an upper edge of the limiting hole, and when the cover body is opened from the first position to a second position relative to the box body, the linkage member abuts against the upper edge of the limiting hole.

9. The packaging box according to claim 8, wherein the cover plate is rotatably connected with the second side wall by a rotating shaft, the cover body further comprises a limiting side plate, a third side wall and a stop portion, the limiting side plate is protruding from the second side wall, the third side wall is configured to extend toward the box body from edges of the cover plate, and the stop portion is connected with an end of the third side wall away from the cover plate, wherein a distance between one part of an edge of the limiting side plate and the rotating shaft is greater than a distance between the stop portion and the cover plate.

10. The packaging box according to claim 9, wherein the limiting side plate comprises a first portion and a second portion, the first portion is adjacent to the second side wall, a distance between an edge of the first portion and the rotating shaft is less than or equal to the distance between the stop portion and the cover plate, the second portion is connected with one side of the first portion opposite to the second side wall, and a distance between an edge of the second portion and the rotating shaft is greater than the distance between the stop portion and the cover plate.

* * * * *